United States Patent [19]

Itoh

[11] 4,314,138

[45] Feb. 2, 1982

[54] APPARATUS FOR APPLYING A MIXTURE OF AIR AND VAPOR TO THE FACE OR HAIR

[76] Inventor: Akira Itoh, 185, Namase 1188, Shiose-Cho, Nishinomiya-City, Hyogo, Japan

[21] Appl. No.: 49,388

[22] Filed: Jun. 18, 1979

[30] Foreign Application Priority Data

Jul. 14, 1978 [JP] Japan ..... 53-97431[U]

[51] Int. Cl.[3] ..... A45D 20/00; A61H 33/06; F22B 1/28; H05B 1/00

[52] U.S. Cl. ..... 219/276; 4/524; 4/537; 34/90; 34/91; 34/99; 128/203.27; 128/368; 132/9; 219/362; 239/136; 261/142

[58] Field of Search ..... 219/271–276, 219/362; 128/203.16, 203.17, 203.26, 203.27, 204.17, 367, 368; 239/136–138; 261/142; 34/90, 91, 96–101; 132/7, 9; 4/524–537

[56] References Cited

U.S. PATENT DOCUMENTS

| | | | |
|---|---|---|---|
| 2,303,465 | 12/1942 | Howard | 4/532 |
| 2,523,912 | 9/1950 | Melchior et al. | 132/9 |
| 3,004,540 | 10/1961 | Ronzi | 34/90 |
| 3,236,359 | 3/1941 | Armstrong | 219/362 X |
| 3,495,343 | 2/1970 | Duncanson | 34/98 |
| 3,511,236 | 5/1970 | Conlin et al. | 219/362 X |
| 3,546,428 | 12/1970 | Omohundro | 219/271 |
| 3,550,285 | 12/1970 | Omohundro | 219/270 X |
| 3,588,444 | 6/1971 | Omohundro | 219/276 X |
| 3,645,007 | 2/1972 | Scott | 219/276 X |
| 3,727,322 | 4/1973 | Walter et al. | 219/275 X |
| 3,863,630 | 2/1975 | Cavallo | 128/203.27 |

FOREIGN PATENT DOCUMENTS

| | | | |
|---|---|---|---|
| 2611500 | 10/1976 | Fed. Rep. of Germany | 132/9 |
| 1009604 | 11/1965 | United Kingdom | 261/142 |

*Primary Examiner*—A. Bartis

*Attorney, Agent, or Firm*—Griffin, Branigan & Butler

[57] ABSTRACT

An apparatus for applying a mixture of air and vapor to the face or hair includes an evaporator comprising a closed tank partially filled with water to leave a residual space thereabove and provided with an electric heater immersed in the water for generating a steam which fills the residual space. A first downwardly sloping tube connects the an attachment, located higher than the tank and adapted to fit on the head or face to be treated, to the residual space. A upwardly sloping second tube connects the outlet of a fan positioned lower than the tank to the residual space. Both the temperature and the flow of the vapor-air mixture can be varied by changing not only the power of the electric heater but also the rotational speed of the fan.

3 Claims, 4 Drawing Figures

10
A
12
18
32
16
26
30
38
40
36
VARIABLE SPEED FAN
20
14
H
22
34
28
24

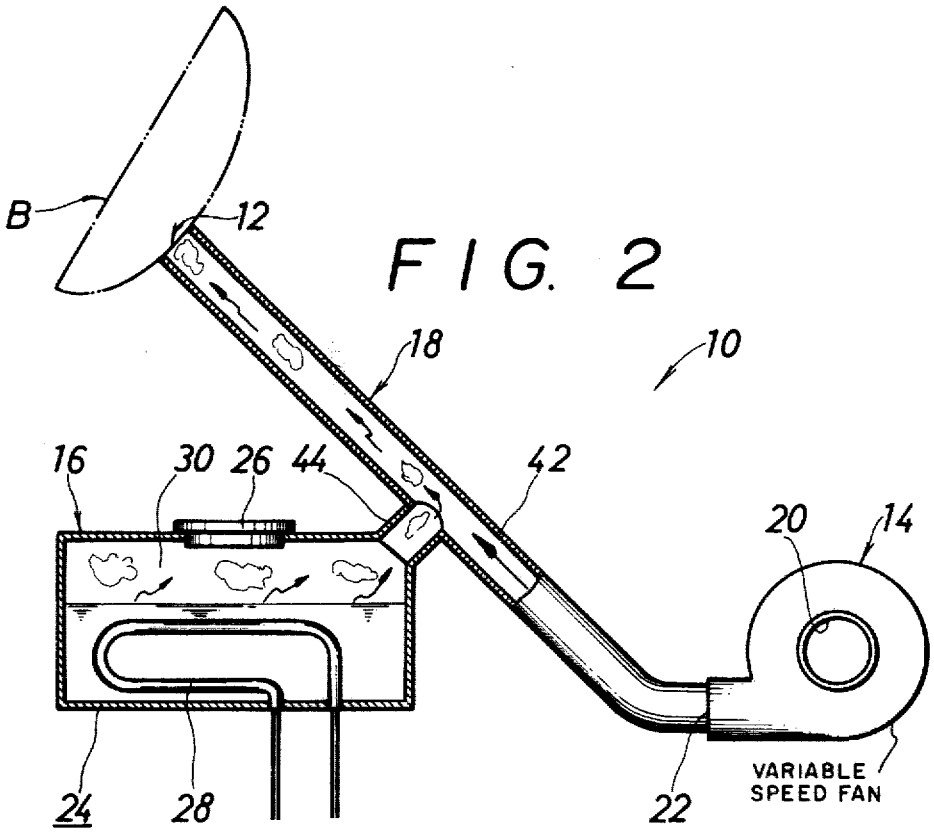
FIG. 2
FIG. 4
(PRIOR ART)
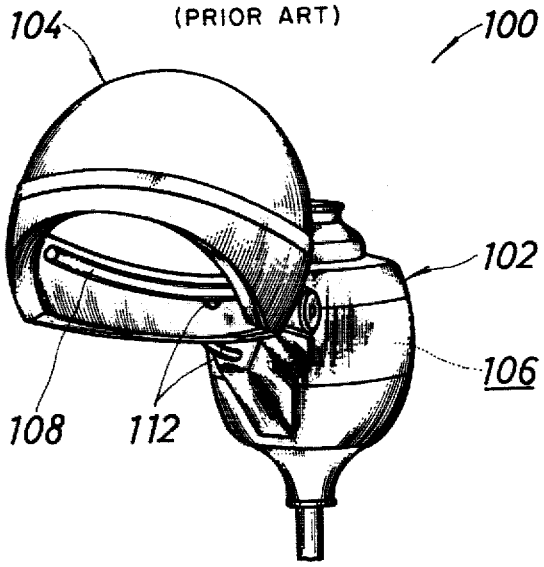

APPARATUS FOR APPLYING A MIXTURE OF AIR AND VAPOR TO THE FACE OR HAIR

BACKGROUND

This invention relates to a hairdressing apparatus which is available to supply adequate moisture to the hair of the head or the face by spraying steam thereupon in order to facilitate the beauty treatment of producing permanent waves, curling hair or shaving faces at barber shops or beauty salons.

A steam hairdressing apparatus as shown in FIG. 3 and FIG. 4 is already known as an apparatus for spraying steam upon hairs of a person in hairdressing treatments. The steam hairdressing apparatus 100 comprises a main body 102 supported on a stand pole (not shown in FIG. 4) and a dome 104 mounted on the main body 102 permitting slight raising or lowering.

The main body 102 has an evaporator 106 therein. An U-shaped spouting tube 108 is equipped inside the dome 104. An exit 110 of the evaporator 106 is connected with a middle point of the U-shaped spouting tube 108 by a flexible communicating tube 112. A plurality of narrow gushing holes 114 are perforated on the spouting tube 108.

The evaporator 106 is usually safely positioned lower than the spouting tube 108. It consists of a closed-type tank 116 for containing water therein and an electric heater 118 fixed in the tank 116.

The electric heater 118 boils and evaporates the water in the tank 116. The hot steam generated by the electric heater 118 ascends through the slant communicating tube 112. Then the hot steam spouts from the gushing holes 114 into the dome 104. The temperature of the steam is nearly 100° C. at the moment of gushing. Cool external air also flows into the dome 104 through a narrow gap between the lower edge of the dome and the head inserted therein. The hot steam and the cool air mix in the dome. If the mixing condition is best, the temperature of the mixed gas becomes 50° C.–60° C. Such a gas is adequate to moisten the hair of the head effectively without danger.

The conventional hairdressing apparatus has some inconveniences.

Because the steam is spouted from the gushing holes 114 by action of the vapor pressure itself, the temperature of the water contained in the tank 116 must always be kept nearly at the boiling point of water—about 100° C. under an ordinary atmospheric pressure. As is well known, the pressure of mixed gases is equal to the sum of the partical pressures of the individual gases. In the closed-type tank 116 exists only aqueous vapour, because no other kind of gas ever flows into the tank 116. The dome 104 is under atmospheric pressure. In order that gas may spout outward into the dome, the pressure in the tank 116 must be higher than the atmospheric pressure. Therefore the temperature must be kept more than 100° C. in the tank 116.

Then the temperature of the aqueous vapor spouting through the gushing holes 114 is still nearly 100° C. It is dangerous that such hot steam is sprayed directly upon the head of a person receiving hairdressing treatment. Though the gushing holes 114 are upwardly directed to increase the chance of mixing steam with cool air, it may be insufficient for creating a full mixture.

Occasionally abrupt boiling phenomena happens in the evaporator 106, when it is overheated more than 100° C. The phenomena is dangerous. It may cause an accidental burn on a head, because hot water—not vapor—of about 100° C. spouts from the gushing holes 114.

Furthermore in the conventional steam hairdressing apparatus, the temperature and the flow of the steam is poorly controllable. The adjustment of the temperature or the flow must be done only by changing the electric power supplied to the electric heater 118. Such a control is very uncertain and inaccurate, because it is indirect and accompanied by a large time lag and large hysterisis.

Finally the work of perforating many narrow gushing holes 114 on the spouting tube 108 is a very tedious process. It lowers productivity and pushes up the cost. Besides, the narrow gushing holes 114 cause a large pressure loss in the flow of steam.

SUMMARY OF THE INVENTION

This invention is contrived to solve the above mentioned difficulties.

A principal object of the invention is to provide a hairdressing apparatus having a fan which inhales external air to forcibly blow the steam generated in the evaporator. In the apparatus cold and dry external air mixes with the hot steam. The mixture of them is a warm gas nearly saturated with aqueous vapor.

Another object of the invention is to provide a hairdressing apparatus wherein the temperature and the flow of the gas can be adjusted by changing not only the electric power of the electric heater but also the rotational speed of the fan.

Yet another object of the invention is to provide a safe hairdressing apparatus. In the apparatus it is hardly necessary to keep the temperature of the water in the evaporator at the boiling point. As the temperature is lower than the boiling point of water, there is much less probability of the abrupt boiling phenomena and no danger of a burn thereby in the invention.

Yet another object of the invention is to provide a hairdressing apparatus which has the evaporator positioned higher than the fan to prevent an adverse flow of steam toward the fan which might happen when one switches off the fan.

To accomplish the above stated objects of this invention, a hairdressing apparatus includes an evaporator mounted intermediate to a fan and an attachment to be fitted upon some portion of the body of a person undergoing hairdressing or beauty treatment. The evaporator includes a closed-type tank for partially containing water with a residual space left above the water and an electric immersion heater mounted in the water for causing the water to evaporate. The residual space communicates with an exhaling exit of the fan via a second communicating tube but is positioned above the exhaling exit of the fan. The residual space communicates with the attachment via a first communicating tube, but is positioned below the exhaust opening of the attachment.

In one embodiment of the invention the speed of the fan is adjustable.

BRIEF DESCRIPTION OF THE DRAWINGS

The above and other objects of the invention as well as various advantages and features of novelty will be apparent from the following description of exemplary embodiments, reference being made to the accompanying drawings thereof.

FIG. 2 is an elevational view in section of another embodiment of the invention;

FIG. 4 is a perspective view of the whole of the conventional hairdressing apparatus.

DETAILED DESCRIPTION OF THE EMBODIMENT

Figure 1:
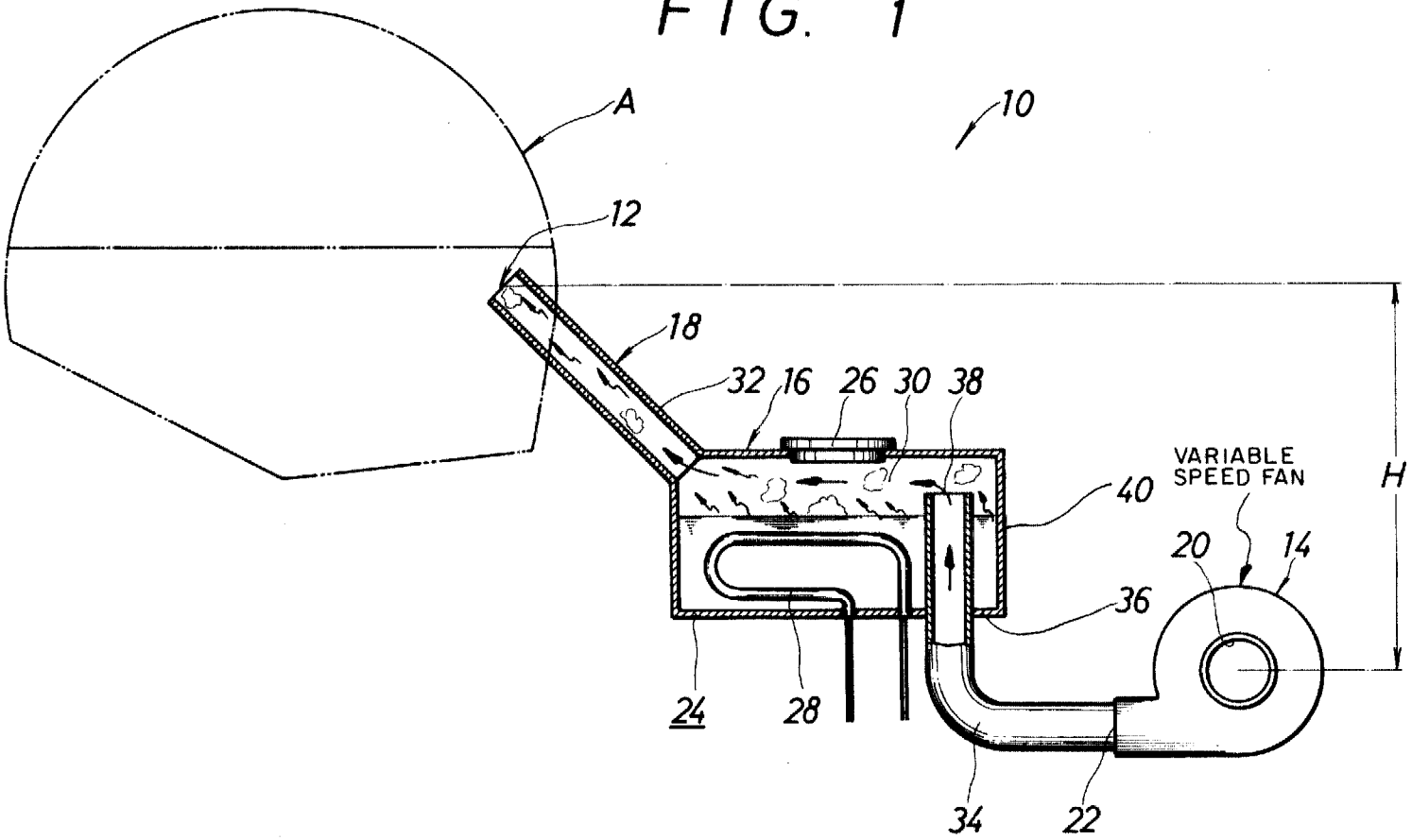
FIG. 1 is an elevational view in section of an embodiment of the invention.
Figure 3:
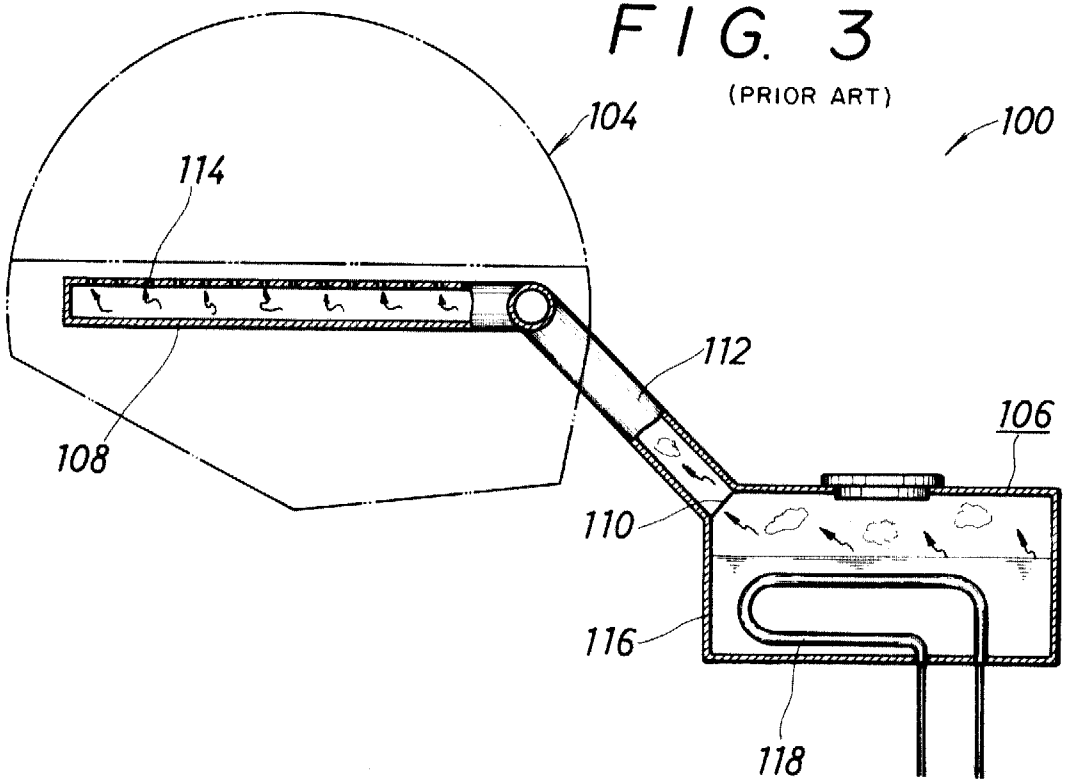
FIG. 3 (PRIOR ART)
FIG. 3 is an elevational view in section of a conventional hairdressing apparatus.

Referring to FIG. 1 a hairdressing apparatus 10 comprises a dome A in which a head of a person undergoing hairdressing treatment will be inserted, a fan 14, a communicating passage 18 which connects the dome A to the fan 14, and an evaporator 16 installed in the communicating passage 18.

The fan 14 has an inhaling entrance 20 and an exhaling exit 22. It inhales a cool and dry external air to blow into the evaporator 16.

The communicating passage 18 consists of a first communicating tube 32 and a second communicating tube 34. The first communicating tube 32 connects the dome A with the evaporator 16. The second communicating tube 34 connects the evaporator 16 with the exhaling exit 22 of the fan 14.

The evaporator 16 comprises a closed-type tank 24 for containing water therein, a cap 26 which covers a hole for replenishment of water, and an electric heater 28.

Normally the electric heater 28 is fully immersed in the water so that the electric heater 28 efficiently boils the water. However, the surface of the water is lower than an opening end 38 of the second communicating tube 34. A residual space 30 is left above the water in the tank 24.

Strictly speaking, the first communicating tube 32 now connects the dome A with the residual space 30 in the tank 24. The second communicating tube 34 connects the residual space 30 with the exhaling exit 22 of the fan 14. Thus the first communicating tube 32 and the second one 34 are coupled together by the residual space 30. As the external air has a large partial pressure, residual partial pressure of vapor is low enough to facilitate a low boiling temperature.

In the embodiment the second communicating tube 34 is inserted into the tank 24 from a bottom plate 36 thereof, so that the opening end 38 is higher than the normal water level.

In the example the tank 24 requires intermittent replenishments of water. But it may be more convenient to fit the tank 24 with an auxiliary tank (not shown in the figures) which continuosly supplies a proper amount of water into the tank 24.

A flexible tube can be conveniently used as the first communicating tube 32. But a rigid tube is also utilizable as the first communicating tube 32. In this case it may be better to affix another flexible tube to the top end of the rigid tube so that the dome A can be fixed upon the flexible tube.

FIG. 1 shows an example which has the dome A wherein the steam sprays upon the hair of the head. But of course another attatchment—for example like a diffuser B as shown in FIG. 2—can replace the dome A. The diffuser B is a shallow vessel for receiving the face of the person undergoing beauty treatment to facilitate shaving facial hair—mustache, beard or whiskers.

Another embodiment as shown in FIG. 2 has another form of communicating passage 18. It is composed of a main tube 42 and a branch tube 44. The main tube 42 directly connects the exhaling exit 22 with the attachment, i.e., diffuser B or dome A. The branch tube 44 connects the residual space 30 of the tank 24 with some portion of the main tube 42.

The evaporator 16 is positioned lower than the exhaust opening 12 of the communicating passage 18 but higher than the fan 14—especially higher than the exhaling exit 22. Then the exhaust opening 12 is higher than the fan 14 by a certain height "H". Of course the residual space 30 of the tank 24 is positioned at an intermediate height between them.

When one switches off the electric heater 16 and the fan 14, the hot water in the tank 24 gets slowly cooler and the hot residual vapor rises through the first communicating tube 32 because of its lighter specific gravity. Evaporation still continues in the transient time. The redidual and newly-evaporated vapor will hardly descend into the second communicating tube 34, because it is filled with cool external air heavier than hot aqueous vapor.

Otherwise, if the fan 14 should be positioned above the evaporator 16, the residual vapor in the tank 24 would enter into the fan 14 through the second communicating tube 34 for a short transient time after the operation of the fan 14 and the heater 28 stops. Then some portion of the residual vapor would be condensed to water in the fan 14. It would cause rapid corrosion of the metal parts of the fan 14 or poor insulation between the electrical part and the casing of the fan 14.

On the other hand if the exhaust opening 12 were lower than the evaporator 16, hot water vapor condensed inside the first communicating tube 32 would drop upon the head or the face of a person undergoing hairdressing or beauty treatment. This would be dangerous, because it would cause a burn on the head or the face. Hot liquid is much more dangerous than hot vapor of the same temperature, as the specific heat of water in unit volume is larger than that of vapor and the thermal conductivity of water is higher than that of vapor.

An advantage of the invention is a highly active system for ventillating warm gas, because the fan 14 blows the steam generated in the evaporator 16 to the exhaust opening 12 quite powerfully.

Another advantage of the invention is a wide freedom of adjustment of the temperature and the flux of the mixed gas. Not only the electric power supplied to the electric heater 28 but also the rotation speed of the fan 14 is variable.

Further advantage of the invention is a high safety. The water in the tank need hardly be heated to the boiling point, because the mixed gas owes its ventilation power to the dynamic force of the fan—not to the static power of evaporation. Abrupt boiling phenomena never happens. Partial pressure of aqueous vapor in the evaporator is kept low enough to hold a low temperature of evaporation by the ventilation of external air through the evaporator by the fan.

Furthermore this invention utilizes a plain tube having an simple opening end as a spouting tube. It is easily manufactured, unlike the conventional spouting tube having many narrow gushing holes.

As many apparently widely different embodiments of this invention may be made without departing from the spirit and scope thereof, it is to be understood that the invention is not limited to the specific embodiments thereof except as defined in the appended claims.

What I claim is:

1. A hairdressing apparatus comprising:

a fan means having an inhaling entrance and an exhaling exit for inhaling relatively cool dry external air through said inhaling entrance and blowing said cool dry external air from said exhaling exit;

an attachment which can be fitted upon some portion of the body of a person in hairdressing or beauty treatment;

a communicating passage which connects the attachment with the exhaling exit of the fan and has an exhaust opening in the attachment; and an evaporator mounted in an intermediate portion of the communicating passage and positioned substantially lower than the exhaust opening but substantially higher than the exhaling exit of the fan, said evaporator including a closed-type tank for partially containing water so that a residual space is left above the water and an electric heater means mounted for heating said water;

said communicating passage being composed of a first communicating tube which connects the attachment with the residual space in the closed-type tank and which slopes downwardly toward the residual space and a second communicating tube which connects the residual space with the exhaling exit of the fan and which slopes upwardly toward the residual space.

2. A hairdressing apparatus as in claim 1 wherein the speed of the fan means is adjustable.

3. A hairdressing apparatus as in claim 1 wherein said electric heater means is an immersion type heater immersed in said water.

* * * * *